US005857319A

United States Patent [19]

Sattelmayer

[11] Patent Number: 5,857,319

[45] Date of Patent: Jan. 12, 1999

[54] METHOD FOR OPERATING A COMBUSTION CHAMBER EQUIPPED WITH PREMIXING BURNERS DIVIDED INTO TWO GROUPS

[75] Inventor: Thomas Sattelmayer, Mandach, Switzerland

[73] Assignee: ABB Research Ltd., Zurich, Switzerland

[21] Appl. No.: 744,271

[22] Filed: Nov. 6, 1996

[30] Foreign Application Priority Data

Dec. 5, 1995 [DE] Germany ..... 195 45 311.5

[51] Int. Cl.[6] ..... F02C 9/00; F02G 3/00

[52] U.S. Cl. ..... 60/39.03; 60/39.37; 60/737; 431/8

[58] Field of Search ..... 60/39.37, 39.03, 60/737, 738, 749, 39.27, 39.29; 431/8, 178, 179

[56] References Cited

U.S. PATENT DOCUMENTS

| | | | |
|---|---|---|---|
| 3,919,838 | 11/1975 | Armstrong et al. | 60/39.281 |
| 3,938,326 | 2/1976 | DeCorso et al. | 60/737 |
| 4,720,970 | 1/1988 | Hudson et al. | 60/39.37 |
| 5,081,844 | 1/1992 | Keller et al. | 60/737 |
| 5,156,002 | 10/1992 | Mowill | 60/738 |
| 5,201,181 | 4/1993 | Ohmori et al. | 60/737 |
| 5,257,502 | 11/1993 | Napoli | 60/747 |
| 5,309,710 | 5/1994 | Corr, II | 60/39.29 |
| 5,339,620 | 8/1994 | Ikeda et al. | 60/39.27 |
| 5,339,635 | 8/1994 | Iwai et al. | 60/737 |
| 5,361,576 | 11/1994 | Muller | 60/747 |
| 5,634,328 | 6/1997 | Ansart et al. | 60/39.03 |

FOREIGN PATENT DOCUMENTS

| | | | |
|---|---|---|---|
| 2013699 | 5/1994 | Russian Federation | 431/178 |

*Primary Examiner*—Timothy Thorpe
*Assistant Examiner*—Ted Kim
*Attorney, Agent, or Firm*—Burns, Doane, Swecker & Mathis, L.L.P.

[57] ABSTRACT

In a method for operating a combustion chamber (4) equipped with premixing burners, under full load all the burners being operated under identical stoichiometric conditions, the burners are subdivided into at least two burner groups (1, 2 and, in the case of operating conditions below full load, the respective burner groups (1, 2) are operated with different air coefficients ($\lambda 1$, $\lambda 2$), that is to say at different flame temperatures (Tgr1, Tgr2). The operating range of the combustion chamber is widened considerably thereby.

7 Claims, 7 Drawing Sheets

METHOD FOR OPERATING A COMBUSTION CHAMBER EQUIPPED WITH PREMIXING BURNERS DIVIDED INTO TWO GROUPS

BACKGROUND OF THE INVENTION

1. Field of the Invention

The invention is concerned with the field of combustion technology. It relates to a method for operating an annular combustion chamber which is equipped with premixing burners and which is used particularly for gas turbines.

2. Discussion of Background

In the light of the low pollutant emission values prescribed for reasons of environmental protection, premixing burners are increasingly used in the operation of gas turbines.

One of the disadvantages of premixing burners is that they are extinguished even when the air coefficients are very low. Depending on the temperature downstream of the compressor of the gas turbine group, this air coefficient $\lambda$ is around 2.

In order to achieve minimal NOx emissions in the case of lean premixing burners, it is customary, under full load, to operate all the burners under identical stoichiometric conditions near the lean extinction limit. Problems arise when the load falls below the full-load value, because, without corresponding countermeasures, the extinction limit is then exceeded, thus leading to the blowout of the premixing burners. Such known countermeasures for flame stabilization are, for example, a redistribution of fuel and/or the changeover to another flame mode and/or the use of the air bypass technique.

For the purpose of applying the "redistribution of fuel" principle, the fuel system is divided into branches which can be shut off or throttled individually. The air flow path remains unchanged with a decreasing load. When the total fuel quantity decreases, some of the valves are closed completely or partially, so that the open parts receive a larger percentage of fuel. This portion then results in the actual flame stabilization.

Another known possibility for maintaining combustion in the low load range is to change over to other flame modes which still guarantee stable combustion at a higher air/fuel ratio, for example diffusion gas stages. A mixed mode, in which the premixing flames are partially enriched, is also known. Complete burnout at air coefficients below 3.5 is thereby possible, that is to say the operating range of 2 to 3.5 can be covered. The higher NOx emissions are a disadvantage here.

Finally, the air bypass technique can also be employed to prevent the blowout of the premixing burners under low loads. For this purpose, as is known, variable orifices, through which the air can flow in in a regulated manner, are arranged in the combustion chamber downstream of the flame. The orifices are closed under full load and are opened with a decreasing load. The aim is to keep the adiabatic flame temperature and therefore also the distance from the extinction limit constant. In many instances, a similar possibility can be achieved by means of a throttle member arranged in the air supply to the burner.

The disadvantage of this prior art which has just been described is that these mechanisms necessitate a complicated fuel distribution and regulation system.

It is desirable, in principle, to operate all the burners in the premixing mode, even under low loads. This can be achieved by a reduction in the mass airflow through the machine (adjustable guide blade stages in the compressor). A known problem which occurs repeatedly is the rise of the gas turbine outflow temperature with a fall in load beyond the predetermined level which puts the lower operating point outside the range within which the premixing combustion principle can be operated.

SUMMARY OF THE INVENTION

The invention attempts to avoid all these disadvantages. It is based on the object of developing a method for operating a combustion chamber equipped with premixing burners, particularly for gas turbines, by means of which method a wide operating range (40–100% load) is covered reliably without any grading of the burners. A simplification of the fuel system, with only slight concessions to the magnitude of the NOx emission values, is to be achieved.

According to the invention, this is achieved in that the premixing burners are subdivided into at least two groups, the respective burner groups being operated under a lower load than full load with different air coefficients. The burners of the various burner groups are therefore stagger-tuned.

The advantages of the invention are, inter alia, a widening of the operating range of the annular combustion chamber operated with premixing burners. Stable operation of the combustion chamber, even in the low load range, is possible without grading. The method is distinguished by the use of a simple fuel system, and only a slight rise in the NOx emissions has to be accepted.

The method can be adopted both when the flame temperature under full load is considerably higher than the lean extinction limit and when the flame temperature under full load is just above the lean extinction limit. In the latter case, the widening of the operating range of the combustion chamber is particularly great.

It is advantageous if the stagger tuning of the burner groups is in the range of 100 to 200K, because even these low values often lead to a sufficient widening of the operating range of the combustion chamber and the associated increase in the NOx values can still be accepted.

It is expedient to regulate the ratio of the air coefficients of the various burner groups by simple means, such as, for example, fuel nozzles of different size or calibrated diaphragms for the fuel conduit, since all the burners can then be connected to the same fuel conduit and operated, so that a simple fuel system is obtained.

BRIEF DESCRIPTION OF THE DRAWINGS

A more complete appreciation of the invention and many of the attendant advantages thereof will be readily obtained as the same becomes better understood by reference to the following detailed description, when considered in connection with the accompanying drawings, in which an exemplary embodiment of the invention is represented and wherein:

FIG. 1A illustrates schematically a burner circuit with devices for control of the air coefficient;

Only the elements essential for understanding the invention are shown.

DESCRIPTION OF THE PREFERRED EMBODIMENT

Figure 1:
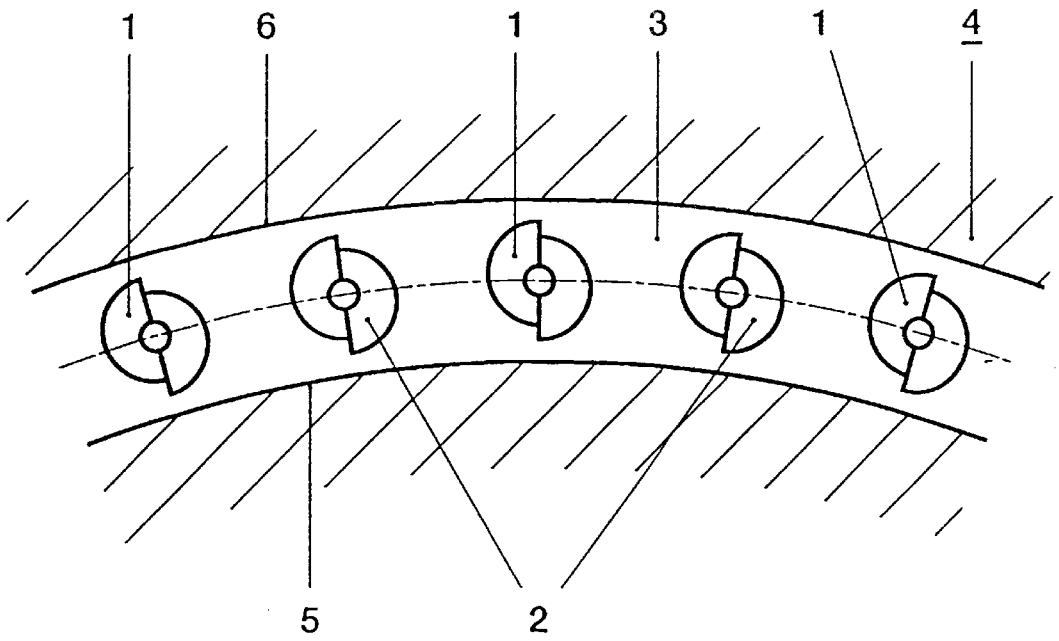
FIG. 1 shows a diagrammatic sector portion of the front wall of an annular combustion chamber with two different burner groups, that is to say operated with different air coefficients.

Referring now to the drawings, wherein like reference numerals designate identical or corresponding parts throughout the several views, FIG. 1 shows a diagrammatic sector portion of the front wall 3 of an annular combustion chamber 4 which is delimited by a combustion chamber inner wall 5 and a combustion chamber outer wall 6 and which is used preferably for generating hot gas for charging a gas turbine not shown here. The annular combustion chamber 4 is equipped with a series of premixing burners, the number of which depends on the machine size and burner size. Burners of the double cone type, which are described in more detail, for example, in U.S. Pat. No. 4,932,861 to Keller et. al., are used as premixing burners.

So that the burners can be operated in the premixing mode, even under low loads, the compressor, not shown here, of the gas turbine group is equipped with rows of adjustable guide blades. The air quantity can thereby be reduced in relation to the full-load quantity.

The premixing burners are divided into two burner groups 1, 2 operated with different air coefficients $\lambda 1$, $\lambda 2$, in the present exemplary embodiment the first burner group 1 and the second burner group 2 having an identical number of burners. Of course, in other exemplary embodiments, other ratios for the number of burners in the two groups 1 and 2 can be selected. In the version represented in FIG. 1, one burner of group 1 and one burner of group 2 are always arranged alternately in the annular combustion chamber 4. However, the spatial arrangement of the burners does not play a decisive part in the method according to the invention, that is to say the burners could also be arranged differently from the version shown in FIG. 1.

Figure 2:
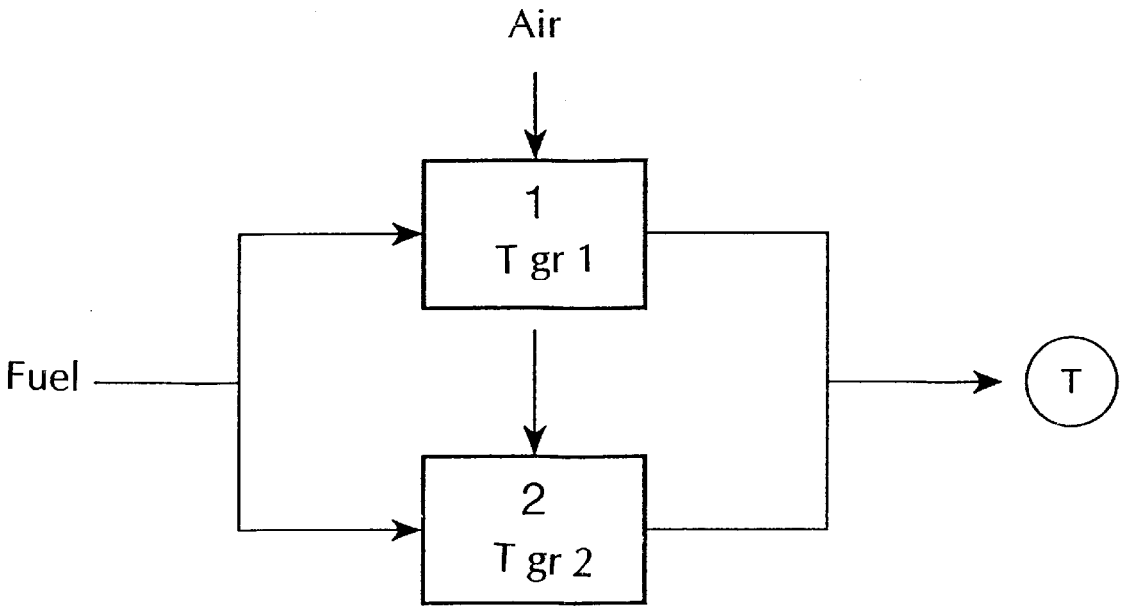
FIG. 2 shows a diagrammatic representation of the burner circuit according to the invention.

FIG. 2 shows a diagrammatic representation of the burner circuit according to the invention. The two burner groups 1 and 2 are "stagger-tuned", that is to say they are operated with different air coefficients $\lambda 1$ and $\lambda 2$ and therefore also have different flame temperatures Tgr1 and Tgr2, of which the mean (with the same number of burners in both groups) then gives an average flame temperature T for the combustion chamber 4.

Figure 3:
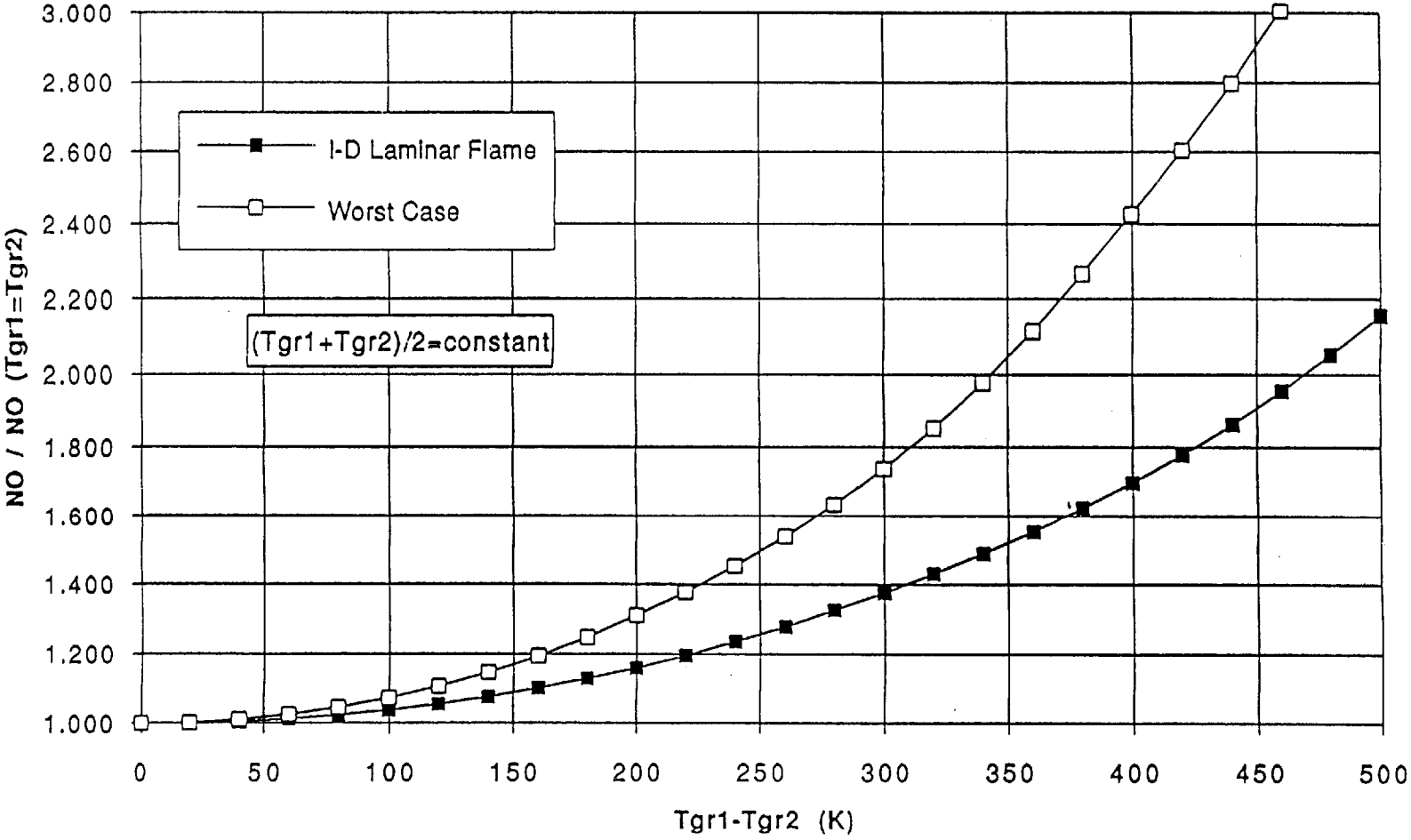
FIG. 3 shows the magnitude of the NOx emissions as a function of the difference in the flame temperatures of the two burner groups, with the same number of burners in both groups and with a constant average flame temperature.

FIG. 3 shows the magnitude of the NOx emissions as a function of the difference in the flame temperatures of the two burner groups 1 and 2, with the same number of burners in groups 1 and 2 and with a constant average flame temperature T. An increase in the NOx values occurs when the method according to the invention is employed, in comparison with a combustion chamber in which the burners are not stagger-tuned, but are operated with a constant air coefficient $\lambda$ and therefore have the same flame temperature, hence in which: Tgr1=Tgr2. This increase is caused by the nonlinear exponential dependence of the NOx production on the flame temperature T.

FIG. 3 shows two extreme cases. The lower curve presupposes kinetically controlled burnout (one-dimensional laminar flame), and the upper curve is based on the assumption of a high dwell time (30 ms here) and the absence of crossmixing between the two burner groups 1 and 2 and therefore represents the worst case. The actual case in gas turbines is in the region between the two curves.

When a flame temperature T of the burners which is in proximity to the lean extinction limit is selected under full load, an increase in the stagger tuning causes the lean burner group to exceed the lean extinction limit. The lean burner group is then controlled by the richer burner group. In order to prevent pulsations, both the burners and the combustion chamber 4 must have a sufficient thermoacoustic stability limit.

The ratio of the air coefficients $\lambda 1/\lambda 2$ of the two burner groups 1 and 2 can be regulated by simple means as shown in FIG. 1A. These means are, for example, fuel nozzles 7, 8 of different size for the two burner groups 1 and 2 or calibrated diaphragms 9 in the fuel conduit. As a result, the premixing stage of all the burners needs to be connected to only one, specifically the less lean fuel conduit 10, so that costs can be saved, because only one simple fuel supply system is necessary.

When the load is reduced, the less lean burners, that is to say the burners which are further away from the lean extinction limit, approach the lean extinction limit of the less lean burner group which limits the average extinction limit of the combustion chamber. At a given full-load flame temperature and a given lean extinction limit of the burners, the necessary operating range and the turbine outlet temperature determine the value required for stagger tuning between the burner groups 1 and 2.

Figure 4:
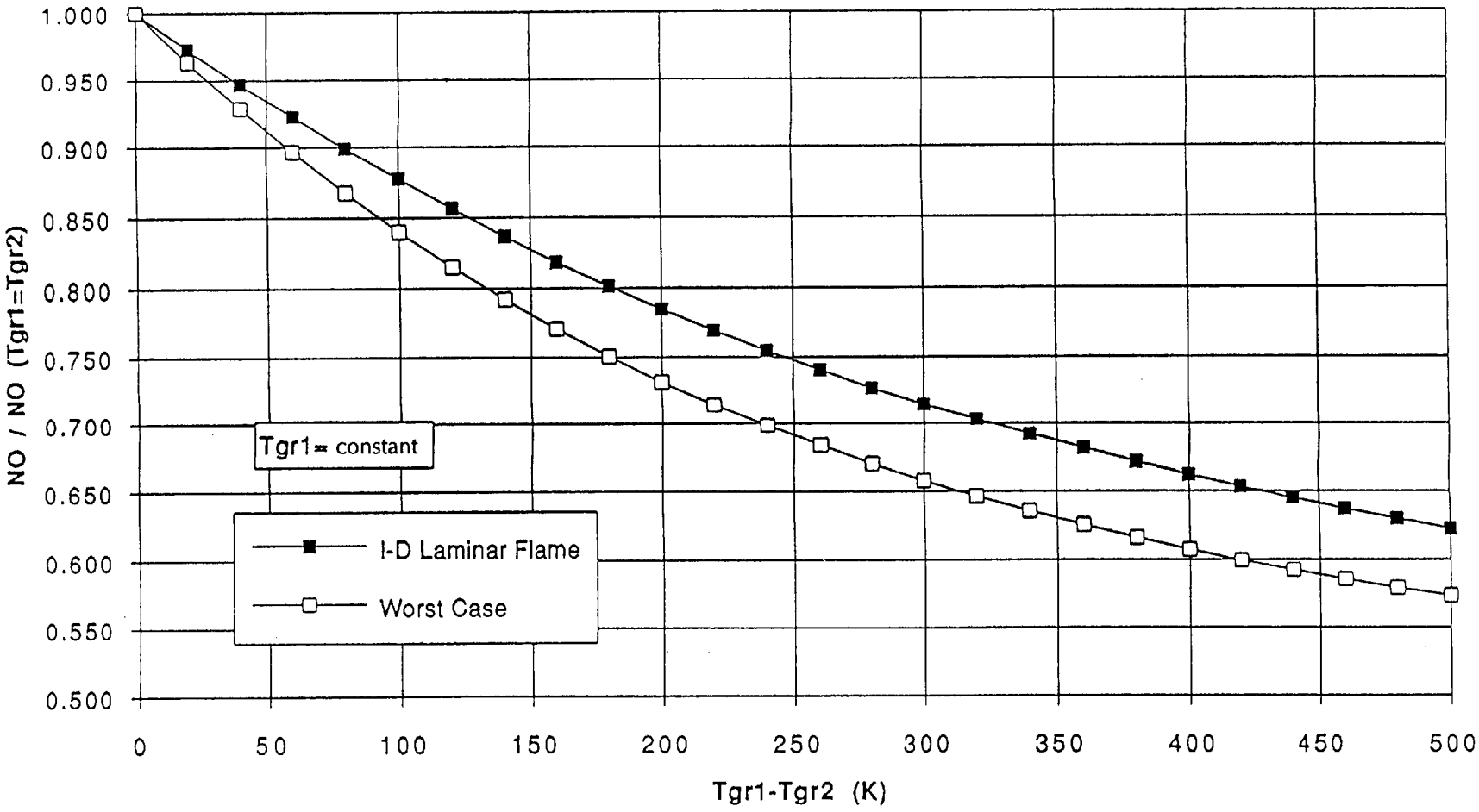
FIG. 4 shows the magnitude of the NOx emissions as a function of the difference in the flame temperatures of the two burner groups, with the same number of burners in both groups and with a constant flame temperature as the first burner group.

FIG. 4 shows the magnitude of the NOx emissions as a function of the difference in the flame temperatures Tgr1–Tgr2 of the two burner groups 1 and 2, with the same number of burners in both groups and with a constant flame temperature of the first burner group (Tgr1=const). The average flame temperature in the combustion chamber is therefore not constant in the event of a variation of Tgr2. The upper curve relates, in a similar way to FIG. 3, to the ideal case of a one-dimensional laminar flame, the lower curve representing the worst case described in more detail above. The total NOx emissions are reduced when the flame temperature Tgr2 of the second burner group 2 is lowered.

Figure 5:
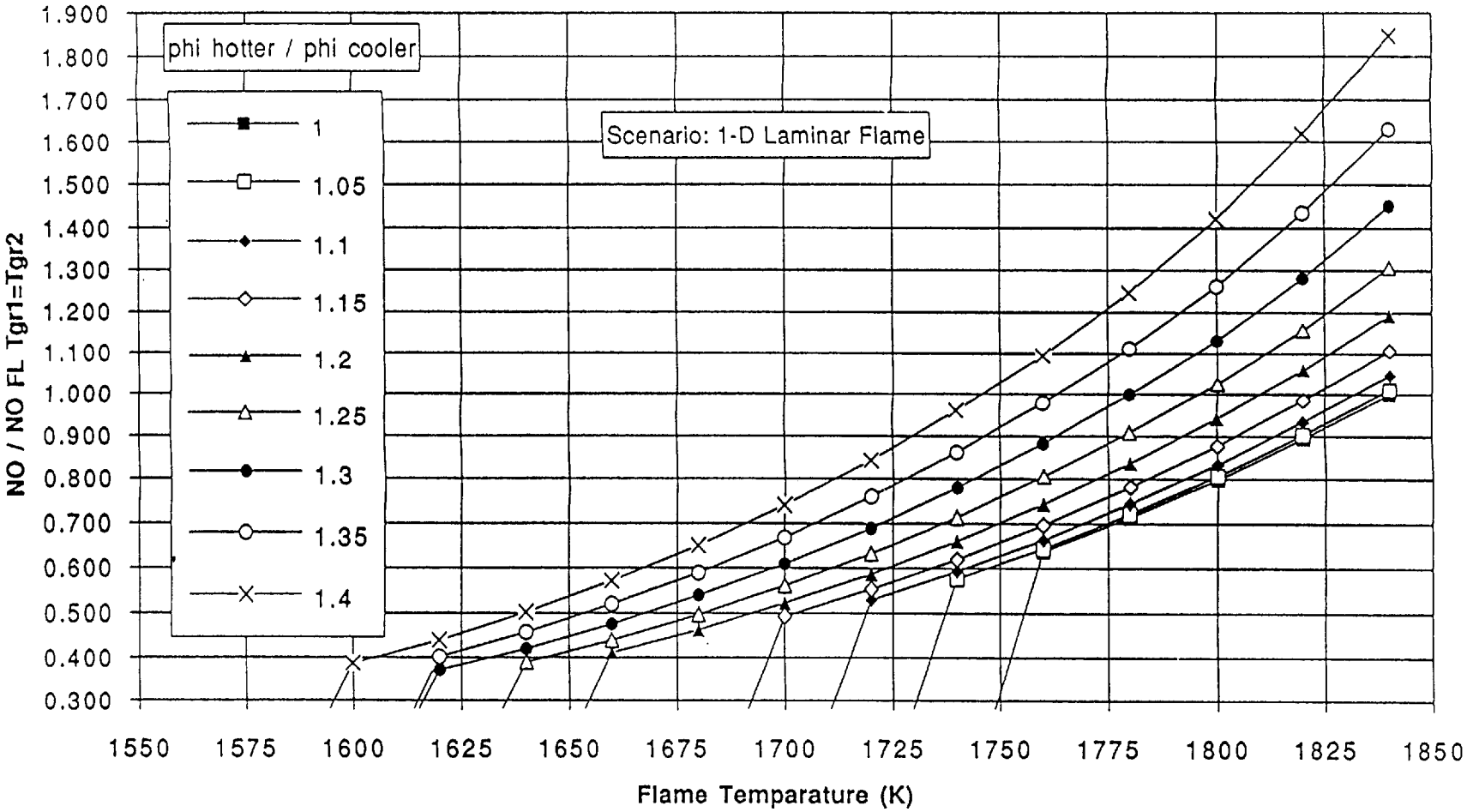
FIGS. 5 and 6 show the magnitude of the NOx emissions as a function of the average flame temperature for different equivalence ratios of the two burner groups, the full-load flame temperature being substantially higher than the lean extinction limit.
Figure 6:
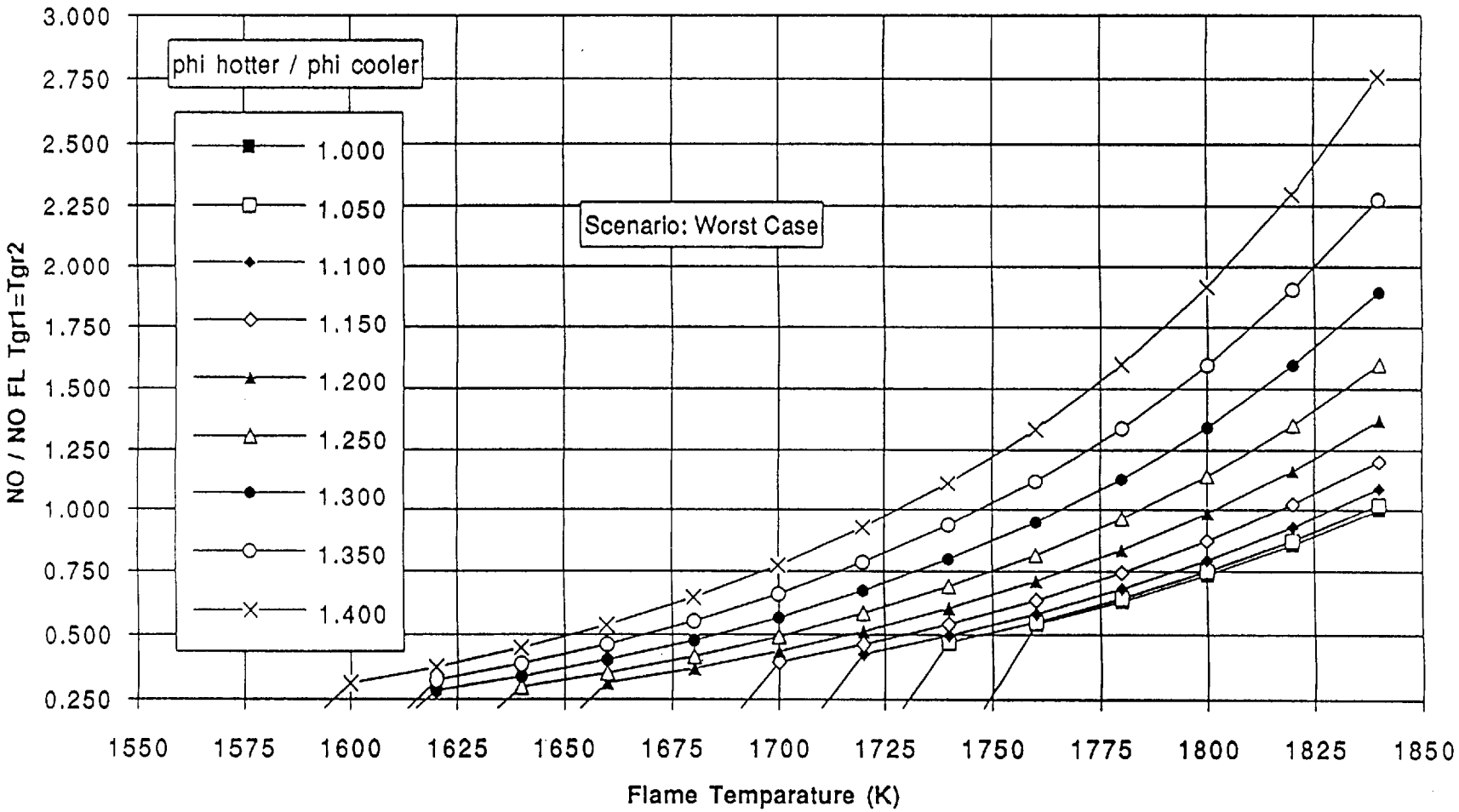

FIGS. 5 and 6 show the magnitude of the NOx emissions as a function of the average flame temperature T for different equivalence ratios $\phi$ of the two burner groups 1 and 2, the flame temperature T being substantially higher than the lean extinction limit. FIG. 5 relates to the case of a one-dimensional laminar flame and FIG. 6 to the above-described worst case. The ratios in actual gas turbines are, once again, between the values of the two curves. As is known, the equivalence ratio $\phi$ is the reciprocal value of the air coefficient $\lambda$. The curves contained in FIGS. 5 and 6 show an increase in the NOx emissions with a rising flame temperature and with a rising quotient of the equivalence ratios of the hotter and the cooler burner group. The lower sloping lines illustrate the shift of the lean extinction limit toward lower flame temperatures, that is to say the operating range of the combustion chamber is widened in the direction of low loads. Only at temperatures in the region below the sloping lines does a blowout of the burners then take place.

Figure 7:
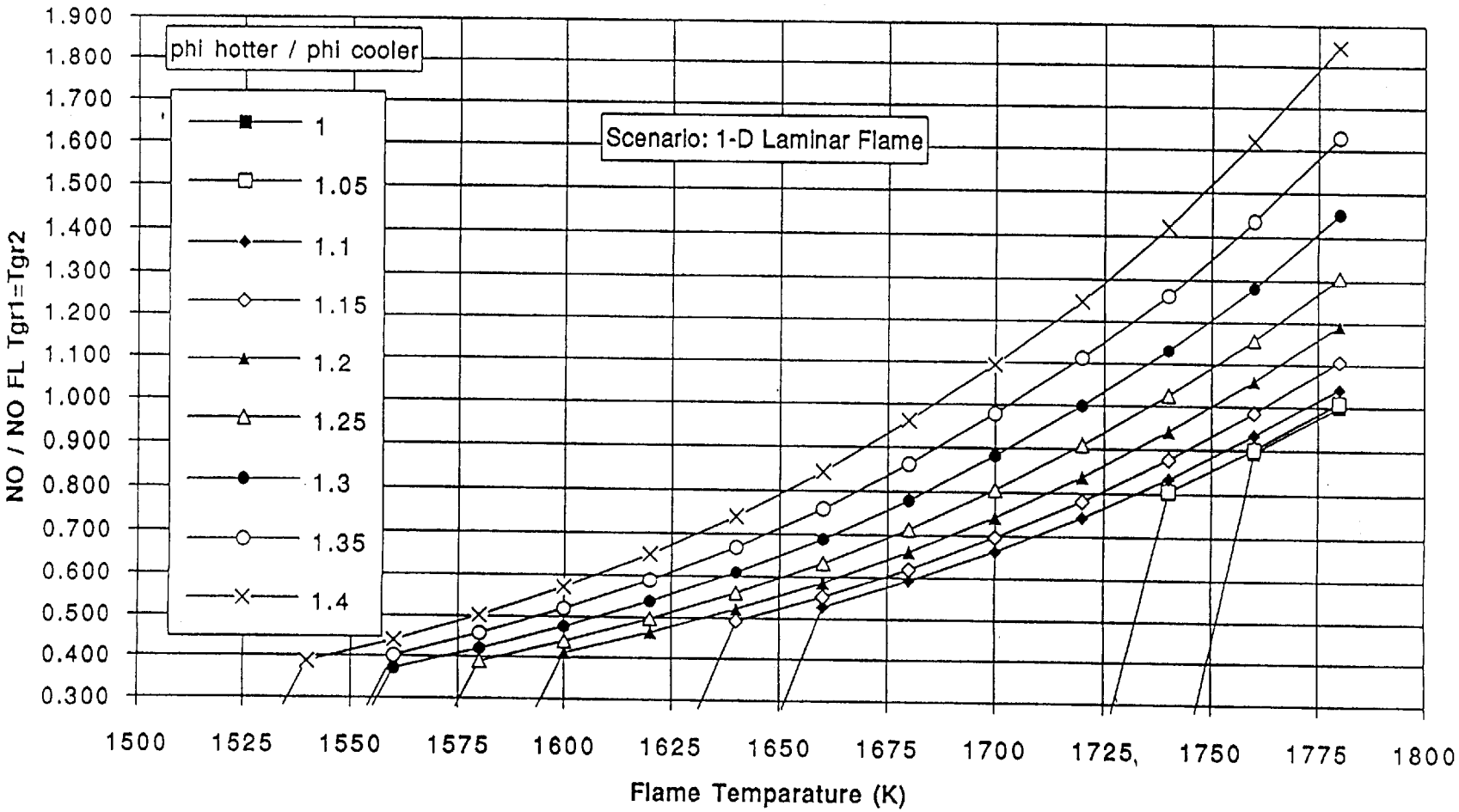
FIGS. 7 and 8 show the magnitude of the NOx emissions as a function of the average flame temperature for different equivalence ratios of the two burner groups, the full-load flame temperature being in proximity to the lean extinction limit.
Figure 8:
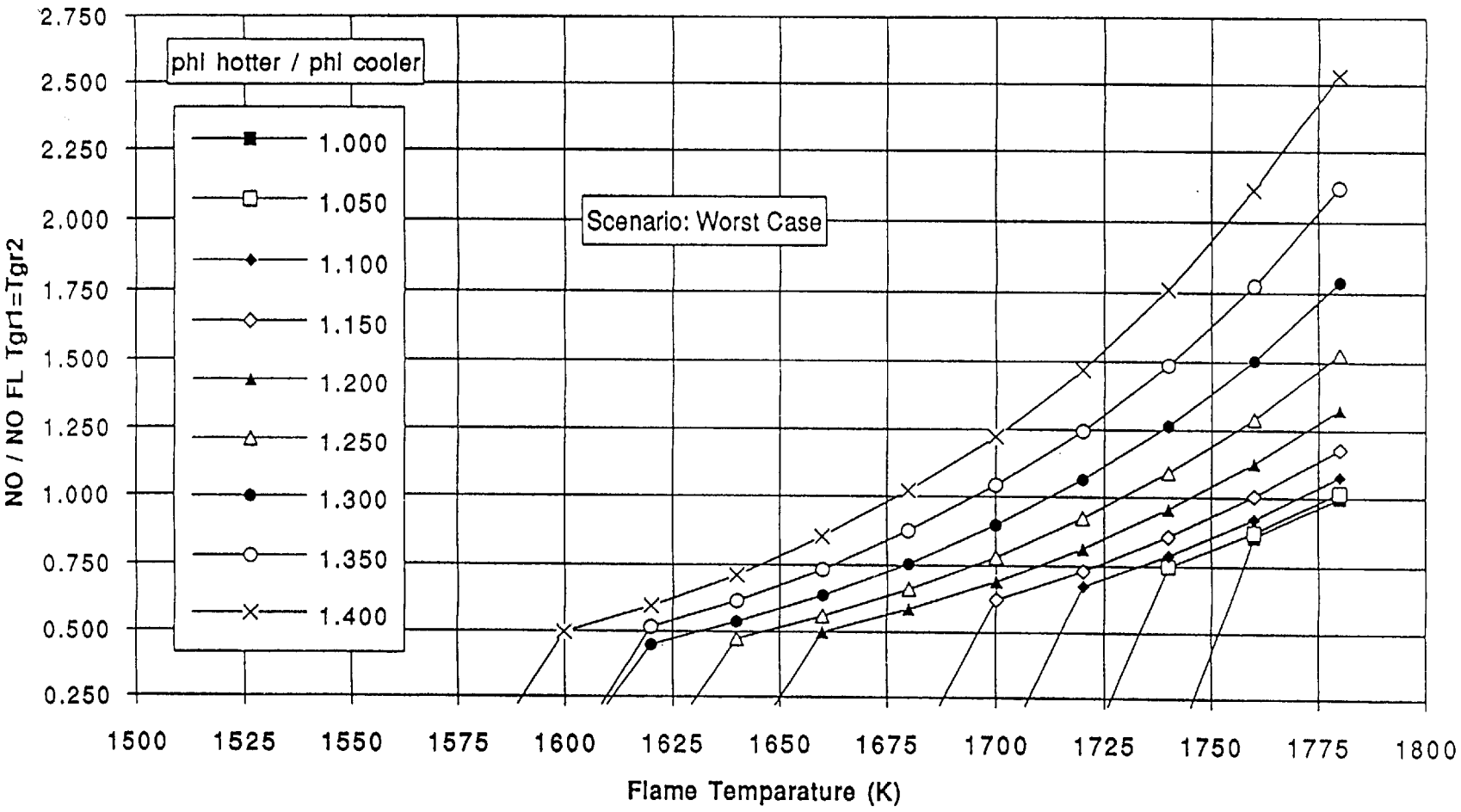

FIGS. 7 and 8 show the magnitude of the NOx emissions as a function of the average flame temperature for different equivalence ratios of the two burner groups, the full-load flame temperature being in proximity to the lean extinction limit. FIG. 7 relates to the case of a one-dimensional laminar flame and FIG. 8 to the above-described worst case. The ratios in actual gas turbines are, once again, between the values of the two curves.

If the numerical values from FIGS. 5, 7 and 6, 8 are compared, the advantage (considerable widening of the operating range) in the case where the full-load flame temperature is in proximity to the lean extinction limit can be seen particularly clearly.

Since, in practice, stagger tuning, that is to say the difference in the flame temperatures Tgr1–Tgr2 of the two burner groups 1 and 2 of about 100 to 200K often already leads to a sufficient widening of the operating range, the slight increase in the NOx emissions which thereby occurs is to be considered acceptable. Strict crossmixing in the annular combustion chamber is advantageous for the uniform temperature profile.

Of course, the invention is not restricted to the exemplary embodiment just described. Thus, for example, three burner groups in a combustion chamber can also be stagger-tuned and operated at different air coefficients and therefore different flame temperatures. Moreover, the method is suitable not only for operating an annular combustion chamber, but, for example, also for operating a silo-type combustion chamber.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method for operating a combustion chamber equipped with a plurality of premixing burners mounted on a front wall of the combustion chamber in a planar arrangement with the burners having a common, axial flow direction for axially ungraded combustion, and the burners being subdivided into at least two burner groups, the method comprising the steps of:

dividing a total quantity of fuel into separate fuel flows for the at least two burner groups, a ratio of the fuel flows being constant;

operating the burner groups under fill load under identical stoichiometric conditions; and, operating the burner groups under part load with mutually different air coefficients to produce different flame temperatures.

2. The method as claimed in claim 1, wherein an average flame temperature under full load is considerably higher than a lean extinction limit.

3. The method as claimed in claim 1, wherein an average flame temperature under full load is just above the lean extinction limit.

4. The method as claimed in claim 1, wherein a difference in the flame temperatures of the burner groups is in the range of 100 to 200K.

5. The method as claimed in claim 1, wherein the ratio of the air coefficients of the at least two burner groups is regulated by calibrated diaphragms in a fuel conduit feeding the burner groups.

6. The method as claimed in claim 5, wherein all the burners are connected to a less lean fuel conduit.

7. The method as claimed in claim 1, wherein the ratio of the air coefficients of the at least two burner groups is regulated by fuel nozzles of different size for the different burner groups.

* * * * *